US005950741A

United States Patent [19]

Wright et al.

[11] Patent Number: 5,950,741

[45] Date of Patent: Sep. 14, 1999

[54] EXTENDED SOIL SAMPLING HEAD

[75] Inventors: Nathan A. Wright, Oak Harbor; Herbert L. Wright, Vickery, both of Ohio

[73] Assignee: Geophyta, Inc., Vickery, Ohio

[21] Appl. No.: 08/915,032

[22] Filed: Aug. 20, 1997

Related U.S. Application Data

[60] Provisional application No. 60/023,355, Aug. 20, 1996.

[51] Int. Cl.[6] ..... E21B 49/02

[52] U.S. Cl. ..... 175/20; 175/209

[58] Field of Search ..... 175/20, 58, 209, 175/210, 211

[56] References Cited

U.S. PATENT DOCUMENTS

| | | | |
|---|---|---|---|
| 3,464,504 | 9/1969 | Stange . | |
| 3,593,809 | 7/1971 | Derry . | |
| 4,284,150 | 8/1981 | Davis . | |
| 4,333,541 | 6/1982 | Doty . | |
| 4,482,021 | 11/1984 | Repski . | |
| 4,534,231 | 8/1985 | Jonsson et al. . | |
| 4,685,339 | 8/1987 | Philipenko . | |
| 4,828,047 | 5/1989 | Rogerson . | |
| 5,058,688 | 10/1991 | Scott et al. | 175/20 |
| 5,076,372 | 12/1991 | Hellbusch . | |
| 5,394,949 | 3/1995 | Wright et al. . | |

*Primary Examiner*—William Neuder
*Attorney, Agent, or Firm*—Marshall & Melhorn

[57] ABSTRACT

A sampling head for a vehicle mounted mechanized soil sample collecting unit includes an auger mounted at one end of a drive shaft supported on a positioning arm on the vehicle. The drive shaft is connected to an auger head which is driven into the soil. A linear power source, such as a hydraulic cylinder is used to provide vertical force to drive the auger head into the soil. A separate rotational power source is used to rotate the drive shaft and auger head. The soil from the drilling process is collected in a receptacle and can be transferred into a separate container for soil analysis.

15 Claims, 2 Drawing Sheets

EXTENDED SOIL SAMPLING HEAD

This application is claiming the benefit, under U.S.C. § 119(*e*), of the provisional application filed Aug. 20, 1996 under 35 U.S.C. § 111(*b*), which was granted Ser. No. 60/023,355. The provisional application Ser. No. 60/261,41, is hereby incorporated by reference.

BACKGROUND OF THE INVENTION

1. Field of the Invention

The present invention pertains to a soil sampling head for collecting soil samples, and more particularly to a lightweight head which is used on a portable soil sampling device mounted on a vehicle. The soil sampling head includes a drive shaft with two separate power supplies for driving an auger into the soil for obtaining individual test samples.

2. Description of the Prior Art

Applicants have previously invented a mobile soil sampling device which is the subject matter of U.S. Pat. No. 5,394,949. All of the structural and operating features of U.S. Pat. No. 5,394,949 are incorporated herein by reference.

In the field of agricultural production, farmers have a need to undertake a soil testing program to determine the proper rates of application of fertilizers and herbicides. In order to achieve more accurate fertilizer application, and thus better utilization, it is highly desirable to assess the soil fertility throughout a field. This requires intensive soil sampling, for example on a field grid basis, involving collection of many soil samples for separate laboratory analysis.

The success of such a soil sampling program depends upon the efficient and inexpensive collection of soil samples. The samples must consistently represent the true soil conditions of an area to be treated. For example, the samples must represent the true available nutrient status of an area to be fertilized, or other appropriate parameters for areas to be treated with herbicides, insecticides and the like.

The majority of technological advances in this field has been in the development of nutrient and herbicide application equipment, and the technique of soil sampling has not kept pace. Many suppliers currently using computer-controlled fertilizer and herbicide applicators still collect soil samples by means of a hand operated hollow tube probe, with no depth indication. Consequently, the soil sampling is highly subjective and operator dependent. The benefits of sophisticated computer-controlled fertilizer and herbicide application cannot be fully utilized unless the precision and accuracy of soil sampling is improved.

As heretofore indicated soil sampling has in the past, and still largely is, done by manually inserting a hollow tube probe into the ground a certain distance, and then withdrawing the probe containing collected soil. The collected soil is then removed from the probe for subsequent analysis. As can be readily appreciated, this is a laborious and time consuming task not conducive to intensive soil sampling. Furthermore, due to resistance to penetration under certain soil conditions and obstructions such as rocks beneath the surface, the samples tend to be taken at different depths so as to produce inconsistent test results.

Various types of mechanical soil samplers have been proposed, a number of them incorporating hollow tube probes into mechanism supplying weight and power for causing the probe to penetrate hard soils. Examples of such devices are disclosed in U.S. Pat. Nos. 3,464,504, 4,284,150, 4,333,541, 4,685,339, and 4,828,047. Other mechanical samplers employ a rotatably driven auger shaft which bores into the soil and withdraws a sample into a receptacle. Such devices are disclosed, for example in U.S. Pat. Nos. 3,593,809, 4,482,021, 4,534,231 and 5,076,372.

These devices are of substantial size and complexity and are generally designed to be operatively mounted upon a large vehicle such as a tractor or a heavy duty pickup truck. While the devices may eliminate the back breaking work of manual probing, each involves either the time consuming step of the operator frequently dismounting the vehicle for sample collection, or the services of two workers, one operating the vehicle and the other operating the soil collection device, to achieve greater speed in sample collecting. The rate of sample collection and efficient use of labor were apparently not of particular significance in the design of the devices. In addition, the prior art vehicle-mounted samplers are limited to use under weather and soil conditions which permit operation of the carrier vehicle, that is, the tractor or pickup truck, in the field. The prior art devices thus do not entirely satisfy the requirements of present day agricultural practices for a soil sampling device which will make possible accurate and rapid collection of soil samples efficiently and inexpensively.

The mobile soil sampling device of the applicants addressed the shortcomings in the prior art. Applicants have invented an improved soil sampling head for use with their mobile soil sampling unit.

SUMMARY OF THE INVENTION

In accordance with the present invention there is provided an improved soil sampling head in which a hydraulic cylinder is used to provide a vertical force on the auger and a separate hydraulic motor provides a rotational force to the auger to drive the auger into the ground for collecting a soil sample.

The head is connected to the positioning arm of the mobile soil sampling device. The head is moved between a drilling position in which the auger is driven into the ground to collect a soil sample in an integral container, and a discharge position in which the soil may be discharge from the container.

The head is lightweight and easy to support at the end of the positioning arm. The auger is longer than the auger on the initial head of the sampling device, which permits deeper soil samples. The new combination of hydraulic cylinder and rotational drive motor provides additional force to the shaft without undue wear or excessive stress to the shaft. The hydraulic leads are fixed on the head to facilitate the delivery of power to the hydraulic cylinder and hydraulic motor.

The sampling head is part of the soil sampling unit which is typically mounted upon a suitable mobile unit or vehicle, preferably a four wheel all-terrain vehicle (ATV). An operator can operate the sampling unit from the seat of the mobile unit without dismounting. The sampling unit includes a positioning arm pivotably affixed at one end to a base mounted upon the mobile unit. At its remote end, the positioning arm pivotably carries the sampling head of the present invention which includes a soil auger and soil accumulator container. An actuator is coupled to the positioning arm for swinging the arm between a lowered soil collecting position and a retracted accumulator container discharge position.

A hydraulic cylinder or other similar power unit is provided for generating vertical force to drive the auger into the ground. A separate motor is used to drive the keyed shaft and rotate the auger. The auger is adapted to be extended through the bottom of the accumulator container and into the earth as the container engages the ground surface upon lowering of the positioning arm. As the auger rotates, the soil sample is drawn upwardly into the accumulator container by the auger flights.

The depth of the auger is determined by the operation of the hydraulic cylinder. The combination of vertical pressure and a separate rotational drive improves the drilling capabilities of the head. Deeper soil samples can be obtained. For example, depths of greater than twelve inches, and preferably greater than three feet, may be obtained through the use of the present invention. Even though the auger is driven deeper into the soil, the wear and tear on the auger head is reduced because of separate controls for the vertical force and the rotational speed when drilling in difficult terrain.

When the positioning arm is in the retracted position, the soil accumulator container of the sampling head is positioned over a funnel device mounted on and positioned above the base. The floor of the accumulator container comprises a hinged trap door which is readily manipulatable by the seated operator for discharging the collected soil sample into the funnel. A suitable receptacle such as a box or bag is positioned beneath the funnel for receiving one or more of the collected soil samples from the accumulator container. A holder may be provided on the base for storing empty receptacles awaiting use and receptacles containing collected samples.

A separate power unit may be mounted upon the mobile unit for operating the positioning arm and the soil auger. Alternatively, the positioning arm and auger unit may suitably be powered by the engine of the mobile unit.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
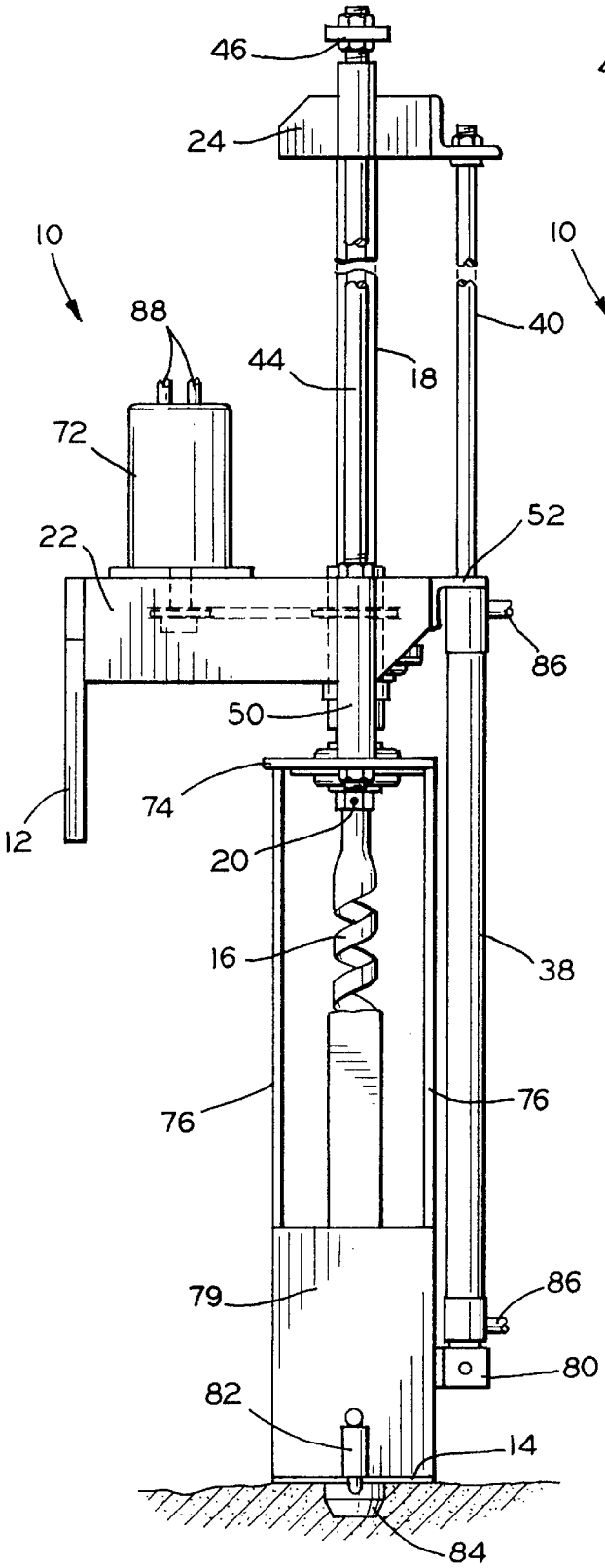
FIG. 1 is a front elevational view of the complete sampling head after the head has been positioned on the soil prior to driving the auger into the soil.
Figure 2:
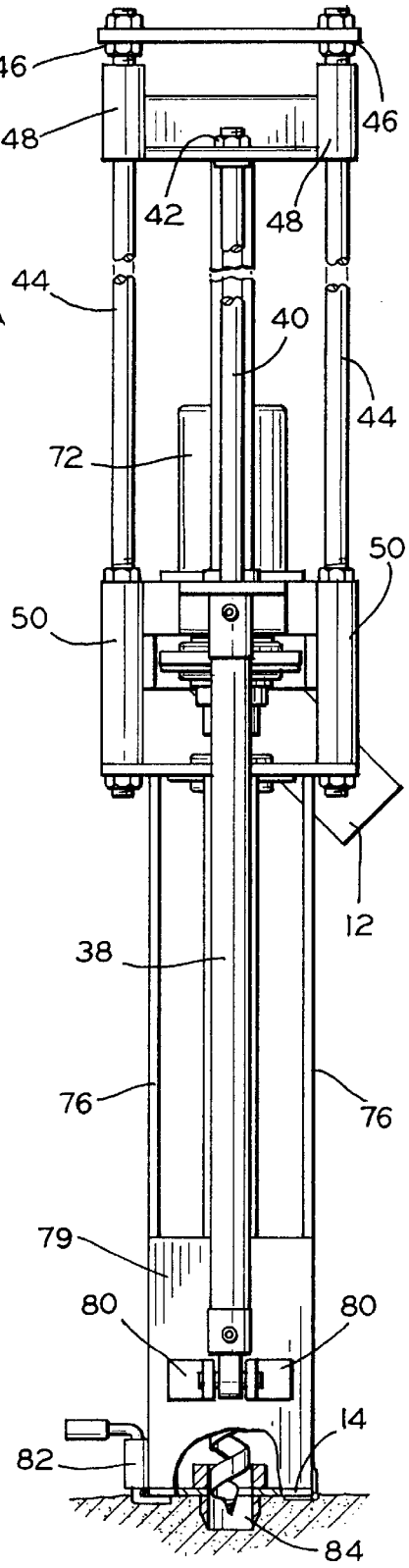
FIG. 2 is a is a side elevational view of the sampling head shown in FIG. 1.
Figure 3:
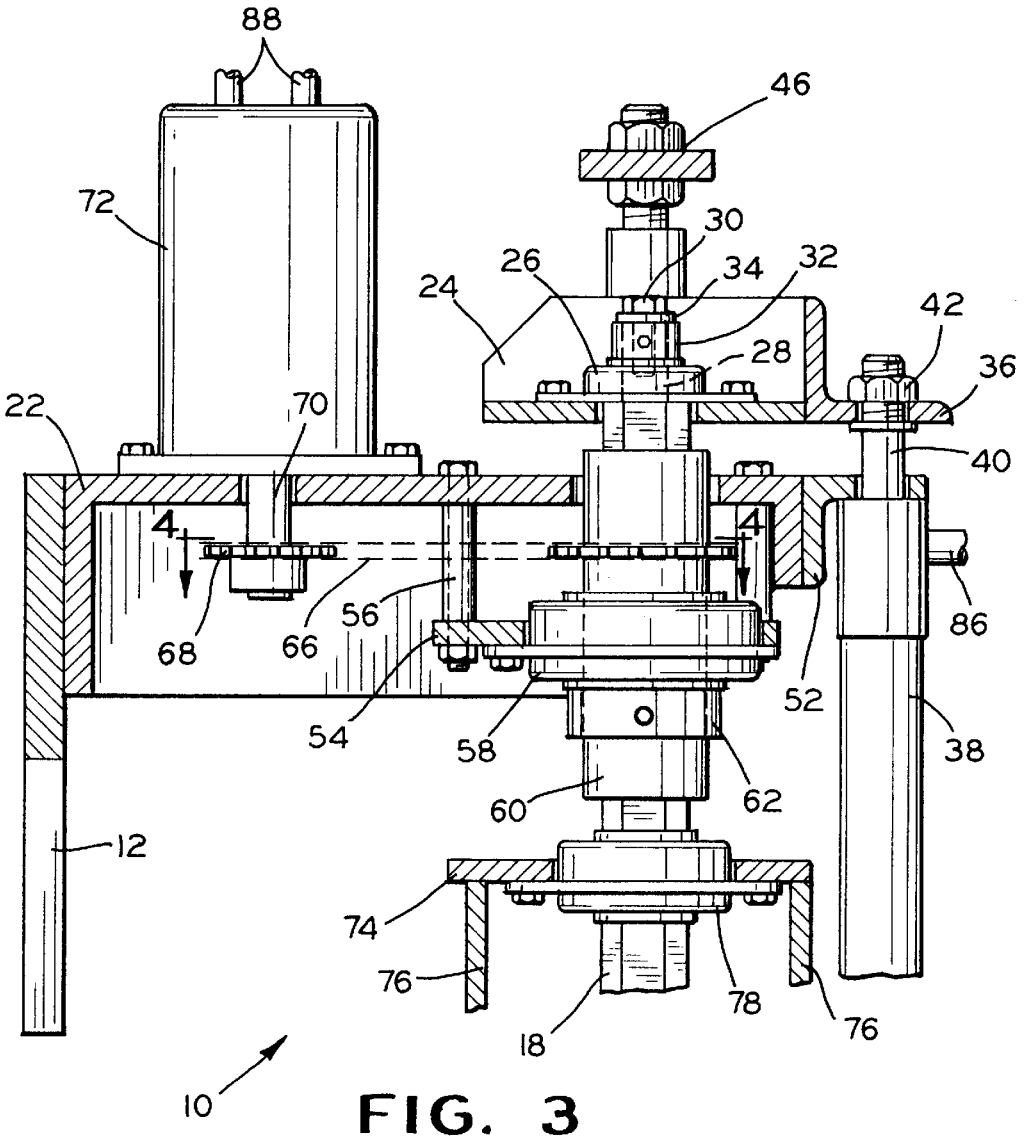
FIG. 3 is a cross-sectional view of the top portion of the sampling head when the auger is extended into the soil to retrieve a soil sample.
Figure 4:
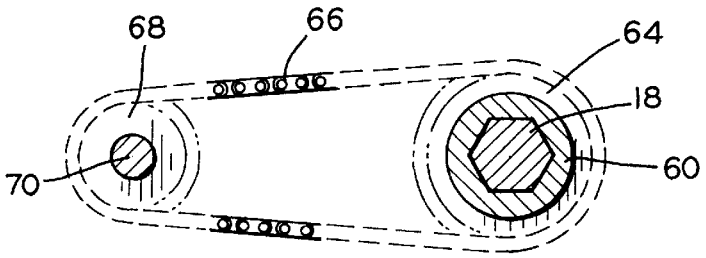
FIG. 4 is a sectional view taken substantially along line 4—4 of FIG. 3.

The present invention is directed to an improved sampling head 10 for use on a mobile soil sampling device such as shown in U.S. Pat. No. 5,394,949, which was invented by the same inventors as the present invention. The features and operation of the mobile soil sampling device of the U.S. Pat. No. 5,394,949 are incorporated herein by reference.

The vehicle used to carry and position the sampling head 10 for gathering soil samples may be an ATV or other vehicle. The vehicle includes a hydraulic power system or other suitable power system (not shown) for positioning and operating the sampling head of the sampling device. A positioning arm (not shown) may be pivotably mounted on the vehicle and includes the sampling head mounted at the free end of the arm. A suitably controlled linear actuator such as a conventional double acting hydraulic cylinder (not shown) is coupled to the positioning arm for operating the positioning arm. When a soil sample is being obtained, the head 10 is extended from the vehicle such that the head is supported in a vertical position on the soil. After a soil sample has been obtained, the support arm is pivoted back onto the vehicle for removal of the soil sample and traveling to the location for the next soil sample. Alternately, the soil sampling head may be attached directly to the vehicle through the use of a frame or bracket.

Referring now to the drawings, there is shown sampling head 10 of the present invention. The sampling head 10 is pivotally carried for free swinging movement at the remote end of the positioning arm so as to assume a vertical orientation regardless of the angular attitude of the arm. The bracket 12 is used to connect the head to the positioning arm in a rotational connection.

The sampling head 10 is designed so that as the positioning arm is lowered, the trap-door base 14 of the head 10 will engage and be urged into contact with the surface of the soil, and the auger head 16 will then be urged into the soil to a limited, predetermined depth.

The auger head 16 is connected to a drive shaft 18 of hexagonal or other irregular cross section. The bottom end of the auger is telescopically received within a mating recess (not shown) in the end of the drive shaft 16 and is secured therein as by a pin 20. The auger may, of course, be of different types as called for by varying soil and operating conditions.

The drive shaft 18 is supported on bracket 12 by a base plate 22. The body of the drive shaft 18 is journalled within, and is axially slidable through, a bearing unit mounted in a central opening in the base plate 22.

The top end of the drive shaft 18 includes a bearing housing 24 made from channel section or other similar material. The bearing 26 receives a reduced diameter portion 28 of the drive shaft 18 and a bolt 30 is used to secure the drive shaft 18 to the bearing housing 24. Collar 32 and washer 34 facilitate the rotation of the drive shaft 18 in the bearing 26.

A flange bracket 36 may be used to secure a hydraulic cylinder 38 with piston rod 40 to the bearing housing 24. The free end of the piston rod is secured to the bracket 36 by a nut 42. Bracket 52 is secured to the base 22 and is used to retain the cylinder 38 and piston rod 40 in the desired vertical configuration.

Slide rods 44 are sized to match the travel distance of the piston rod 40 of the hydraulic cylinder 38. The top end 46 of the slide rods 44 are slidingly inserted through the top sleeves 48 in the bearing housing 24 and are bolted to a support plate or tie rod across the top of the bearing housing 24. The bearing housing 24 slides on the slide rods 44 as the auger head 18 is lowered and raised. The lower ends of the slide rods 44 are secured in and supported by the housings 50 on the base plate 22.

For purposes of further stabilizing the drive shaft 18 as it rotates, a circular bearing 58 is mounted in a bearing plate 54 affixed in spaced relation beneath the base plate 22 as by bolts and spacers 56. The drive shaft is journalled within and axially slidable through the hex hollow sleeve 60 and collar 62. The hollow sleeve 60 extends through the bearing 60 to facilitate the rotational movement of the drive shaft 18.

The rotational movement is provide by a drive system which includes a sheave or sprocket 64 affixed to the hollow sleeve 60, a continuous chain 66, and a drive sheave or sprocket 68 mounted on shaft 70 of hydraulic motor 72. The hydraulic motor is vertically mounted on base plate 22.

The slide rod housings 50 extend between and are secured to both the base plate 22 and the bearing plate 74. A hex bearing 78 is mounted on the bearing plate 74 to further stabilized and support the rotatable drive shaft 18.

The simultaneous and separately controlled rotational movement of the drive shaft 18 while the drive shaft 18 is forced through the hollow sleeve 60 provides the operator of the sampling device with improved control of the auger 16 of the sampling head 10. This two drive system reduces the stress on the drive shaft 18 and auger head 16 when drilling in hard or uneven soil conditions.

Oppositely disposed pairs of side bars 76, secured at their upper ends by the bolts to the bearing plate 74, depend downwardly and are affixed at their lower ends to a soil accumulator container 79 defined by side walls and a trap door or floor 14. The lower end of the hydraulic cylinder is connected to the container by brackets 80.

A latch mechanism 82 is provided along the edge of the receptacle 79 for selectively latching the trap door in a closed position and allowing it to pivot downwardly for discharging collected soil. In order to accommodate the auger 16 as it is extended from the receptacle 79 for gathering a soil sample, the trap door 14 is provided with a central opening 132 having a slightly greater diameter than that of the auger. The rotating auger may tend to displace soil laterally at the soil surface-trap door interface as it bores into the soil, particularly if the soil surface is uneven so that the trap door does not seat firmly against the surface. To obviate this condition an annular collar 84 is affixed within the aperture or to the underside of the trap door 14 surrounding the aperture. As the sampling head 10 is lowered by the support arm, the collar 84 is depressed into the soil to avoid any gap between the soil surface and the trap door 14, and thereby to prevent lateral displacement of soil by the auger 16.

The cylinder 38 and motor 72 are preferably hydraulic powered. However, other and different units such as air motors and electric motors, may be employed as well. For example, an electric motor and a linear actuator may be utilized to insert and retract the auger. An electric motor may also be used to rotate the drive shaft of the auger. With the preferred embodiment, hydraulic power is supplied by a hydraulic pump and reservoir unit driven by a gasoline engine. The hydraulic pump provides fluid under pressure through a conduit to a control unit (not shown). The control unit is manually operable to selectively supply fluid power to move the positioning arm to position the sampling head 10, and to operate the hydraulic cylinder 38 and motor 72 for driving the auger 16 into the soil.

The hydraulic power system is connected by hoses to the ports 86 on the cylinder 38 and ports 88 on the motor 72. A control lever on the control unit is manually operable by the operator for controlling hydraulic power to the motor 72 for rotating the drive shaft 18 in either direction. Power is also delivered to retract the piston rod 40 of the hydraulic cylinder 38 to drive the auger 16 into the soil. Once the auger has reached the desired soil depth, the cylinder 38 is operated to extend the piston rod 40 and raise the auger 16. Because the cylinder 38 and motor 72 are in a fixed position on the head 10, the hydraulic hoses can be secured on the head 10 to prevent undesirable tangling or kinking of the hoses during repeated operations.

In operation, the sampling head 10 is positioned on the soil for the drilling of a soil sample. The motor 72 is used to rotate the drive shaft 18 and auger 16 in a clockwise direction. Once the auger head 16 is rotating, the cylinder 38 is used to drive the auger head 16 into the ground by retracting the piston rod 40. The rotational speed of the drive shaft 18 and the amount of vertical force applied to the drive shaft 18 is controlled by the operator on the ATV to achieve the desired drilling performance.

At the start of the drilling cycle, the tip of the auger head 16 is typically aligned with the trap door 14 of the receptacle 79. The depth of the drilling is determined by the length of the piston rod 40 of the cylinder 38. The slide rods are sized based on the length of the piston rod 40. As the piston rod 40 is retracted during the drilling operation, the bearing housing 24 slides down the rods 44 until the bearing housing 24 reaches the slide rod housings 50.

The hex hollow sleeve 60 and the matching hex-shaped drive shaft 18 permits movement of the drive shaft 18 in an axial direction through the sleeve 60. The interlocking hex configuration of the housing 60 and drive shaft 18 facilitates the translation of the rotational force from the motor 72 to the drive shaft 18. In operation, the drive shaft 18 is simultaneously rotating and sliding through the sleeve 60 in order to drive the auger head 16 into the soil. The soil augerings are brought up into the receptacle 79 by the auger flighting.

Once the auger head 16 has reached the desired depth, the operating direction of the motor 72 and cylinder 38 are reversed to raise the auger head 16 from the soil and to dislodge the soil from the auger head into the receptacle 79. The positioning arm raises the head for removal of the soil from the receptacle 79. The head 10 is maintained in the raised position while the sampling device is moved to the location for the next soil sample.

The sampling head 10 is lightweight to facilitate the positioning of the head. The separation of the drilling process into two separate power sources, one for vertical force and one for rotational force, allows for the use of standard hydraulic components. The separate hydraulic power sources also provide the operator with improved control of the auger head 16 during the drilling operations. Soil samples can be obtained from hard and uneven soil without damaging the auger head.

It is to be understood that the forms of the invention herewith shown and described are to be taken as illustrative preferred embodiments only of the same, and that various changes in the shape, size and arrangement of parts may be resorted to without departing from the spirit of the invention.

What is claimed is:

1. a soil sampling head for use on a mechanized soil sampling device such that the sampling head is positioned on the soil for collecting a soil sample, said head comprising:

a receptacle positioned on the soil;

an auger vertically aligned and adapted to be selectively advanced through the receptacle and into the soil for drawing soil upwardly into said receptacle;

a drive shaft vertically aligned with and connected to an upper end of the auger;

a linear power source connected to said drive shaft for forcing said auger into the soil; and a rotating power source connected to said drive shaft for simultaneously rotating said auger, said rotating power source remaining stationary relative to the linear movement imparted to said drive shaft by said linear power source, whereby driving said auger into the soil and withdrawing the auger from the soil deposits a sample of soil in the receptacle.

2. A soil sampling head as recited in claim 1, further comprising a means for discharging the soil sample from the receptacle.

3. A soil sampling head as recited in claim 2, wherein said means for discharging the soil sample is a hinged door having an aperture through which the auger may extend.

4. A soil sampling head as recited in claim 3, wherein said hinged door has a latching mechanism for selectively opening and closing said hinged door.

5. A soil sampling head as recited in claim 4, wherein said receptacle includes an annular collar surrounding the aperture.

6. A soil sampling head as recited in claim 1, further comprising a positioning arm having a fixed end pivotally attached to a vehicle, and a free end attached to the soil sampling head.

7. A soil sampling head as recited in claim 6, wherein said positioning arm includes a means for actuating the positioning arm for selective movement of the soil sampling head.

8. A soil sampling head as recited in claim 6, wherein said vehicle is an all terrain vehicle having a power source for actuating the linear power source and the rotating power source of the soil sampling head.

9. A soil sampling head as recited in claim 1, wherein said linear power source and said rotating power source are either hydraulic, electric, or pneumatic.

10. A soil sampling head as recited in claim 1, wherein said auger extends greater than twelve inches into the soil.

11. A soil sampling head as recited in claim 1, wherein said linear power source comprises a hydraulic cylinder with a piston rod, including cylinder control means for selectively axially extending and retracting said piston rod.

12. A soil sampling head as recited in claim 8, wherein the linear power source comprises a hydraulic cylinder and rotating power source comprises a hydraulic motor, including a hydraulic pump mounted on said vehicle, means for driving said hydraulic pump, and conduit means operably coupling said hydraulic pump to said hydraulic cylinder and said hydraulic motor.

13. A soil sampling head as recited in claim 1, wherein said rotational movement is provided by a hydraulic motor, said hydraulic motor having a drive sheave, said drive sheave connected to a driven sheave on said drive shaft by a chain.

14. A soil sampling head as recited in claim 1, further comprising a bracket attached to said soil sampling head for mounting said soil sampling head onto a vehicle.

15. A soil sampling head for use on a mechanized soil sampling device such that the sampling head is positioned on the soil for collecting a soil sample, said head comprising:

a receptacle positioned on the soil;

an auger vertically aligned and adapted to be selectively advanced through the receptacle and into the soil for drawing soil upwardly into said receptacle;

a drive shaft vertically aligned with and connected to an upper end of the auger;

a linear power source connected to said drive shaft for forcing said auger into the soil said drive shaft defining a longitudinal axis; and a rotating power source connected to said drive shaft for simultaneously rotating said auger, said rotating power source having an output shaft defining a longitudinal axis which is offset from the longitudinal axis of said drive shaft, whereby driving said auger into the soil and withdrawing the auger from the soil deposits a sample of soil in the receptacle.

* * * * *